US006152056A

United States Patent [19]

Ulerich et al.

[11] Patent Number: 6,152,056

[45] Date of Patent: Nov. 28, 2000

[54] RIGID OBJECT EMBROIDERY HOOP ASSEMBLY

[76] Inventors: Phillip L. Ulerich, 57 Mallard Dr., Piitsburgh, Pa. 15238; Keith Kearney, 1600 Mary's Ave., Sharpsburg, Pa. 15215

[21] Appl. No.: 09/453,161

[22] Filed: Dec. 2, 1999

[51] Int. Cl.[7] ..... D05C 9/04

[52] U.S. Cl. ..... 112/103

[58] Field of Search ..... 112/103, 102, 112/470.14; 38/102.2; 412/35

[56] References Cited

U.S. PATENT DOCUMENTS

| | | | |
|---|---|---|---|
| 1,547,486 | 7/1925 | Zinser | 412/35 X |
| 3,405,670 | 10/1968 | Scholl et al. . | |
| 3,443,536 | 5/1969 | Rolauffs et al. . | |
| 3,664,288 | 5/1972 | Von Boden et al. . | |
| 3,732,638 | 5/1973 | Hanley . | |
| 4,411,208 | 10/1983 | Nishida et al. . | |
| 4,598,488 | 7/1986 | Inteso | 112/103 X |
| 4,834,006 | 5/1989 | Goto . | |
| 5,101,746 | 4/1992 | Frye . | |
| 5,138,960 | 8/1992 | Intenso . | |
| 5,291,843 | 3/1994 | Hori . | |
| 5,509,367 | 4/1996 | Conley, Jr. . | |
| 5,590,613 | 1/1997 | Head . | |
| 5,666,895 | 9/1997 | Gehres et al. . | |
| 5,842,429 | 12/1998 | Gulotta . | |
| 5,887,534 | 3/1999 | French et al. | 112/103 |

*Primary Examiner*—Peter Nerbun
*Attorney, Agent, or Firm*—Law Offices of K. Patrick McKay

[57] ABSTRACT

A device for supporting semi-rigid workpieces to be embroidered. Hoop ties are mounted to a hoop frame to provide a support surface for one side of the workpiece, while a backbone further comprising at least two knurled fingers provide a frictional supporting surface for an opposing side of the workpiece. Rubber tubing can be stretched around the hoop ties for easily mounting each of the ties to the hoop frame, and which provides another frictional supporting surface that is less abrasive than the knurled hoop fingers. The angle and the height of the backbone can be adjusted to accommodate workpieces of varying rigidity and thickness.

7 Claims, 6 Drawing Sheets

RIGID OBJECT EMBROIDERY HOOP ASSEMBLY

BACKGROUND OF THE INVENTION

1. Field of the Invention

The present invention relates to embroidery hoops used to stretch and support material to be embroidered. In particular, a device for stabilizing and stretching stiff or semi-rigid articles such as cloth, leather, or vinyl bound articles is disclosed.

2. Description of the Related Art

Frames for supporting fabric while being embroidered are known in the art. Generally rectangular frames, which are mainly suited for fabric and canvas pieces, are known to support the material to be embroidered by including two piece frames that mate to define an area wherein the fabric can remain taut. In this way, the fabric material can be also easily and manually moved underneath a reciprocating needle. As seen in U.S. Pat. No. 3,732,638, by Hanley, a lower frame and upper frame are mated by studs through opposing apertures, and through which canvas is placed to allow the threads of the material to remain aligned longitudinally and laterally. U.S. Pat. No. 5,138,960, by Intenso, teaches a similar device used in the process of embroidering fabric which has a generally rectangular appearance and includes a magnet means to secure the two sections together to ensure that the material is held tightly, whereby a taut and flat surface is provided.

Embroidery frames and clamps are also known to be configured in alternative shapes and include structures to enable the workpiece to attach to automatic embroidery machines. The automation of the embroidering machine has allowed the fabric workpieces to be supported by a variety of clamps and frames that also include attachment means for mounting on the machines. In U.S. Pat. No. 4,411,208, by Nishida et al., three circular frame members are adapted to secure a cloth and are mounted on the traveller of the embroidery machine by a clamping means. The orientation of the cloth has to be adjusted without the removal of the cloth from the frame. More recently, mounting brackets have been developed to be more supportive to hold larger or heavier frame members, as seen in U.S. Pat. No. 4,834,006 by Goto.

In contrast to the above mentioned frames and others that are suited to hold and support material of the fabric or canvas type, there is a need for a device that supports substantially thick and semi-rigid objects, such as books or portfolios. Different hoops, or supporting bands or surfaces for embroidered workpieces, accommodate a variety of frames for supporting different types of workpieces to hold the material taut. This is necessary because not all hoop supports are suited to accommodate certain workpieces. To accommodate tubular-shaped fabric, U.S. Pat. No. 5,842,429, by Gulotta, teaches a hoop support attachment for a computerized embroidery sewing machine that improves the sewing quality of tubular goods, such as shirt or jacket sleeves. Thus, material that is of different size and shape can not always be accommodated by typical hoop supports for embroidery machines.

The present invention is structurally designed to support generally flat, semi-rigid items that have a substantial thickness, and which have a folded top surface to be embroidered and stitched to a harder underlying surface, such as book or portfolio cover, or a heavy paper or cardboard folder. Many cloth, leather, or vinyl bound articles are constructed to be too stiff for a conventional hooping method. These items are highly valued as personal items when embroidered. This device stabilizes and stretches stiff, or semi-rigid articles in the embroidery machine work area while the stitching is applied. The article is not creased, marked, or damaged in any way, yet it is stabilized to allow accurate embroidery.

SUMMARY OF THE INVENTION

It is the objective of the present invention to provide a hoop frame for holding a stiff or semi-rigid workpiece by bending rather than clamping, as the workpiece is held against the rigid frame at the boundary of the work area.

It is a further objective of the present invention to keep the workpiece stabilized by high friction components. Two metal fingers have a knurled surface for placement on the underside of the workpiece. Other opposing metal fingers have rubber tubes circumferentially disposed thereon to provide a surface for the opposing visible area of the workpiece, thereby the visible area of the workpiece is unmarked while being supported.

It is further an objective of the present invention to allow the fingers to be adjustable so the clamping force and the angle of the fingers is variable depending on the size of the workpiece. The knurled fingers are attached to a backbone made adjustable by opposing fasteners and are arranged to work together, one in tension and the other in compression to control the finger angle relative to the frame and thereby the pressure distribution along the workpiece. The magnitude of force being applied is also controlled by these fasteners by adjusting the workpiece deflection.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention relates.

Figure 1:
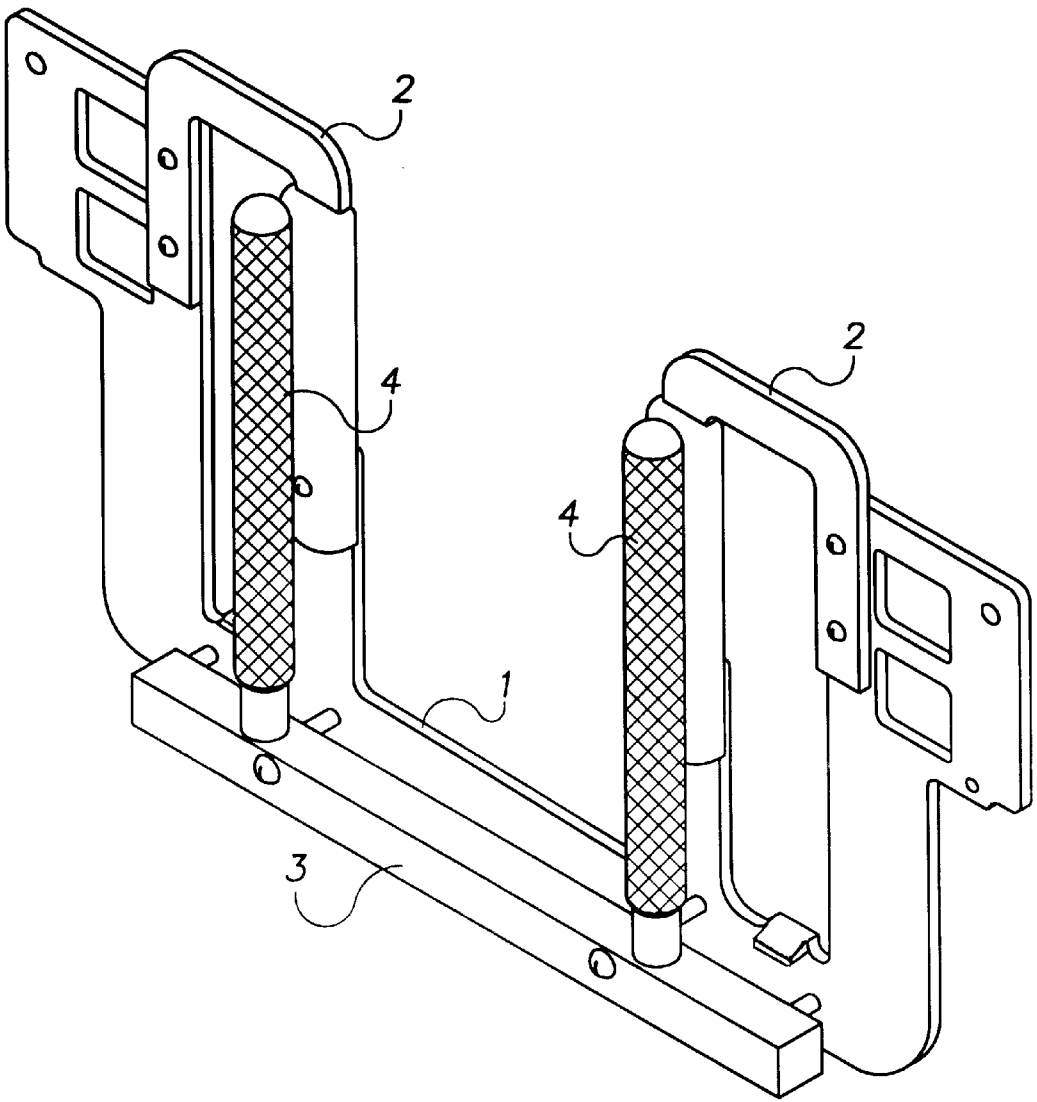
FIG. 1 shows a perspective of the hoop assembly with the main subassemblies.

FIG. 1 shows the complete hoop assembly as fully assembled for use with an embroidery machine. There are, essentially, four main subassemblies that the hoop assembly comprises. At least two hoop ties 2 are removably attached to a hoop frame 1. The hoop ties 2, at least two of them, are preferably mounted by screws to the hoop frame 1. The hoop ties 2 are provided as an additional support surface for any workpiece.

A horizontal backbone 3 is also adjustably attached to the base of the hoop frame 1. The backbone 3 supports at least two hoop fingers 4, which extend upwards and perpendicularly therefrom. The hoop fingers 4 provide the additional support on an opposing side of the workpiece when situated on the hoop frame 1 as further described.

Figure 2:
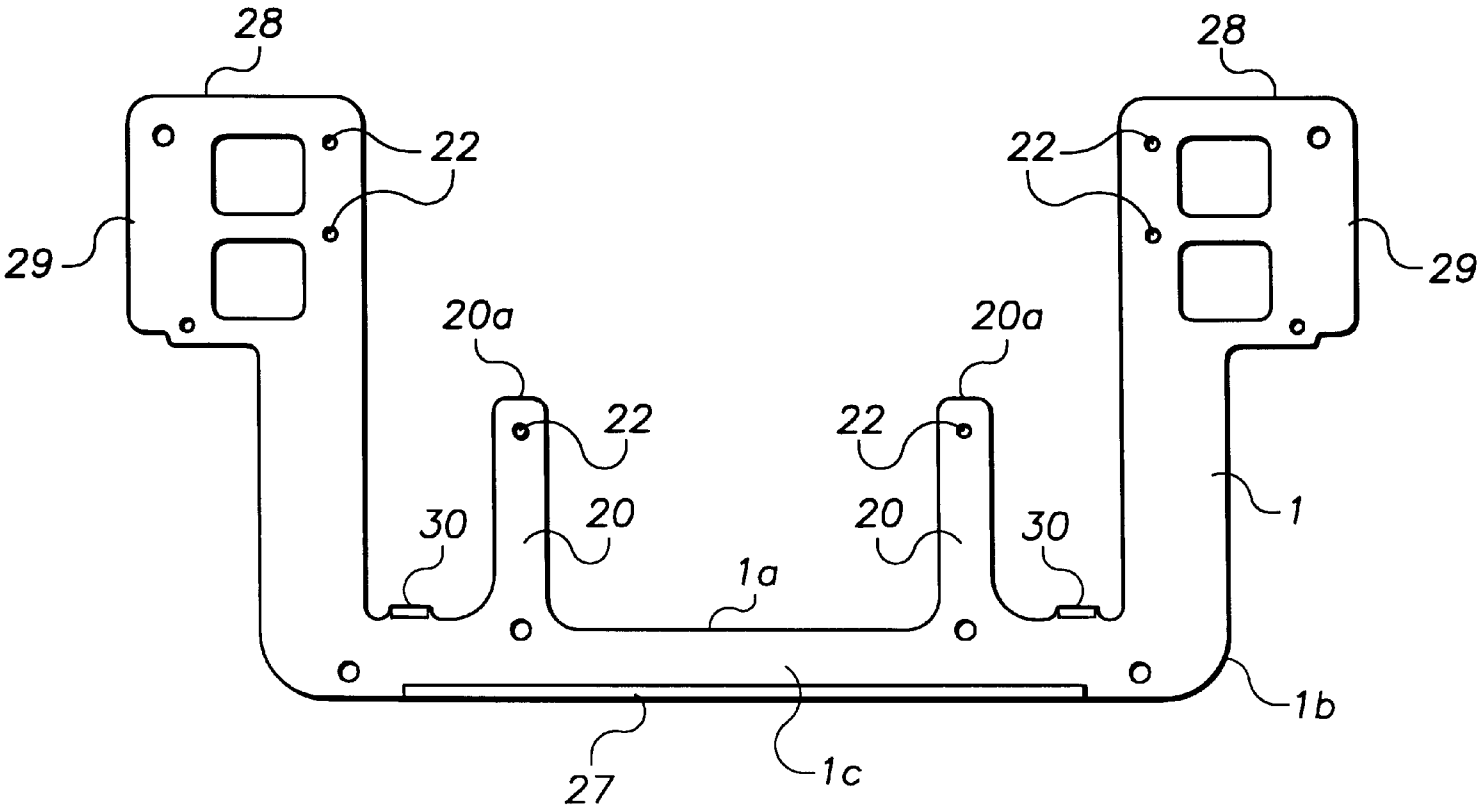
FIG. 2 shows a front view of the hoop frame whereon the backbone with the fingers and the hoop ties are mounted.

FIG. 2 shows, in more detail, the design of the hoop frame 1. The outer perimeter l*b* defines the hoop frame 1 as generally U-shaped with the two upper ends 28 extending outwards to define a mounting means 29, which allows the hoop frame 1 to be mounted on an embroidery machine by mating with any of the various connection methods used by the machine's manufacturer.

The inner surface la of the hoop frame 1 is generally U-shaped, with the exception that at least two hoop tie situators 20 extend perpendicularly upwards from the inner surface 1*a* and formed integral with the hoop frame 1 near the hoop frame base 1*c*. A plurality of support holes 22, on both the upper ends 28 of the hoop frame 1 and proximate to the tip 20*a* of each hoop tie situator 20, allow the hoop ties 2 (FIG. 1) to be attached to the hoop frame 1 by screws, bolts, or other rivet members.

At least two workpiece stops 30 abut the inner surface 1*a* of the frame 1 proximate to each hoop tie situator 20 for leveling an outer edge of the workpiece, as the edge is disposed against the workpiece stops 30. The workpiece stops 30 may be configured as any raised finger formed integral with the hoop frame 1.

Figure 8:
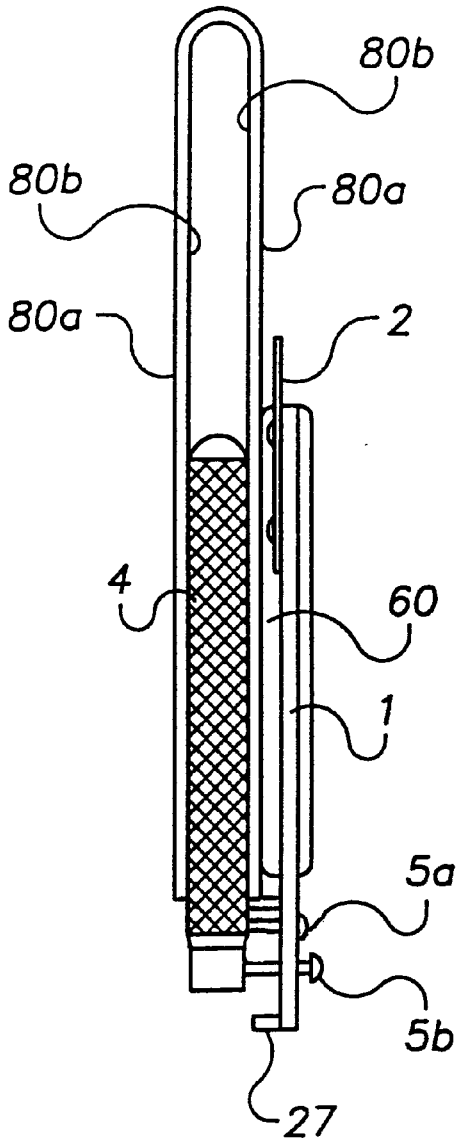
FIG. 8 is a side view of the hoop assembly showing the positioning of a semi-rigid portfolio cover being secured by the hoop assembly to be embroidered.

A stiffening rib 27 is formed as a perpendicular bend disposed at the hoop frame base 1*c*, which is also shown in a side view in FIG. 8. The bend in the stiffening rib 27 stiffens the hoop frame 1 to reduce deflection and stress.

Figure 3:
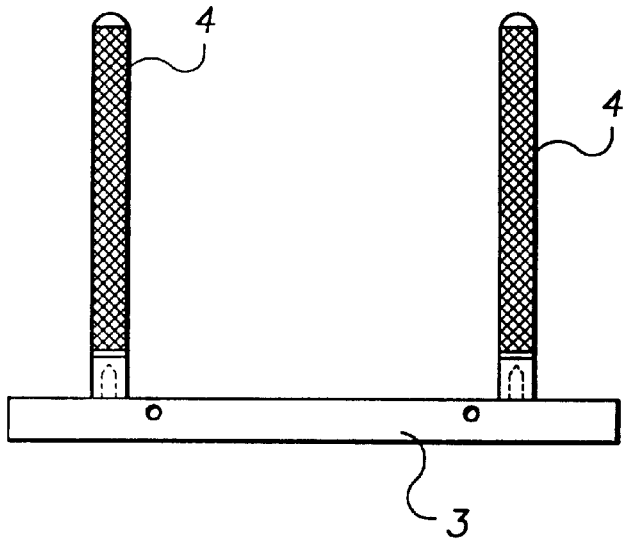
FIG. 3 shows a front view of the backbone with the knurled fingers, which provide a frictional surface for securing the workpiece.

FIG. 3 shows the hoop fingers 4 extending from the backbone 3. The hoop fingers 4 can be made of a hard plastic, but are preferably made of metal, such as aluminum, and are knurled to provide a frictional surface. The friction provided by the knurling of the surface of the hoop fingers 4 prohibit the workpiece from moving while being embroidered, as further described.

Figure 4:
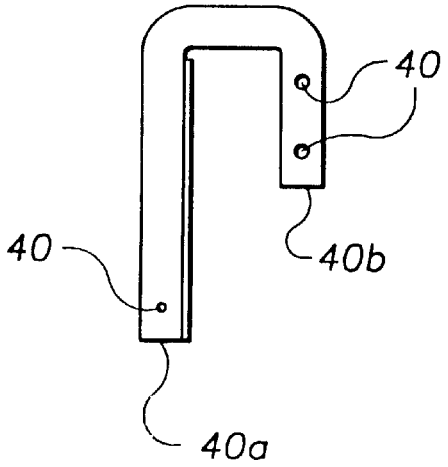
FIG. 4 shows a front view of one of the hoop ties used to support the workpiece thereon.
Figure 5:
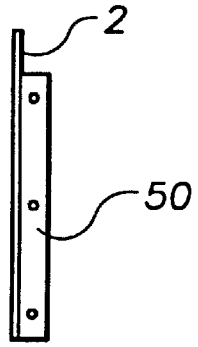
FIG. 5 shows a side view of the same one hoop tie revealing a support vertically disposed perpendicularly therefrom for allowing a rubber tube to be stretched around for providing another, yet less abrasive frictional surface for securing the workpiece.

FIG. 4 shows the design of one of the hoop ties 2. Being generally shaped similar to an inverted J, the hoop tie 2 has some hoop tie holes 40 at a lower end 40*a* and a terminal end 40*b* for allowing attachment to the hoop frame 1 (FIG. 2). As seen in the side view shown in FIG. 5, there is a rubber tube support 50 formed integral with and perpendicularly extending upwards as a lip from the hoop tie 2 along the length of the hoop tie 2. The rubber tube support 50 allows a rubber tube to be stretched around the hoop tie 2, thereby another frictional surface that is less abrasive than the hoop finger 4 knurled surface is provided for an opposing and visible side of the workpiece.

Figure 6:
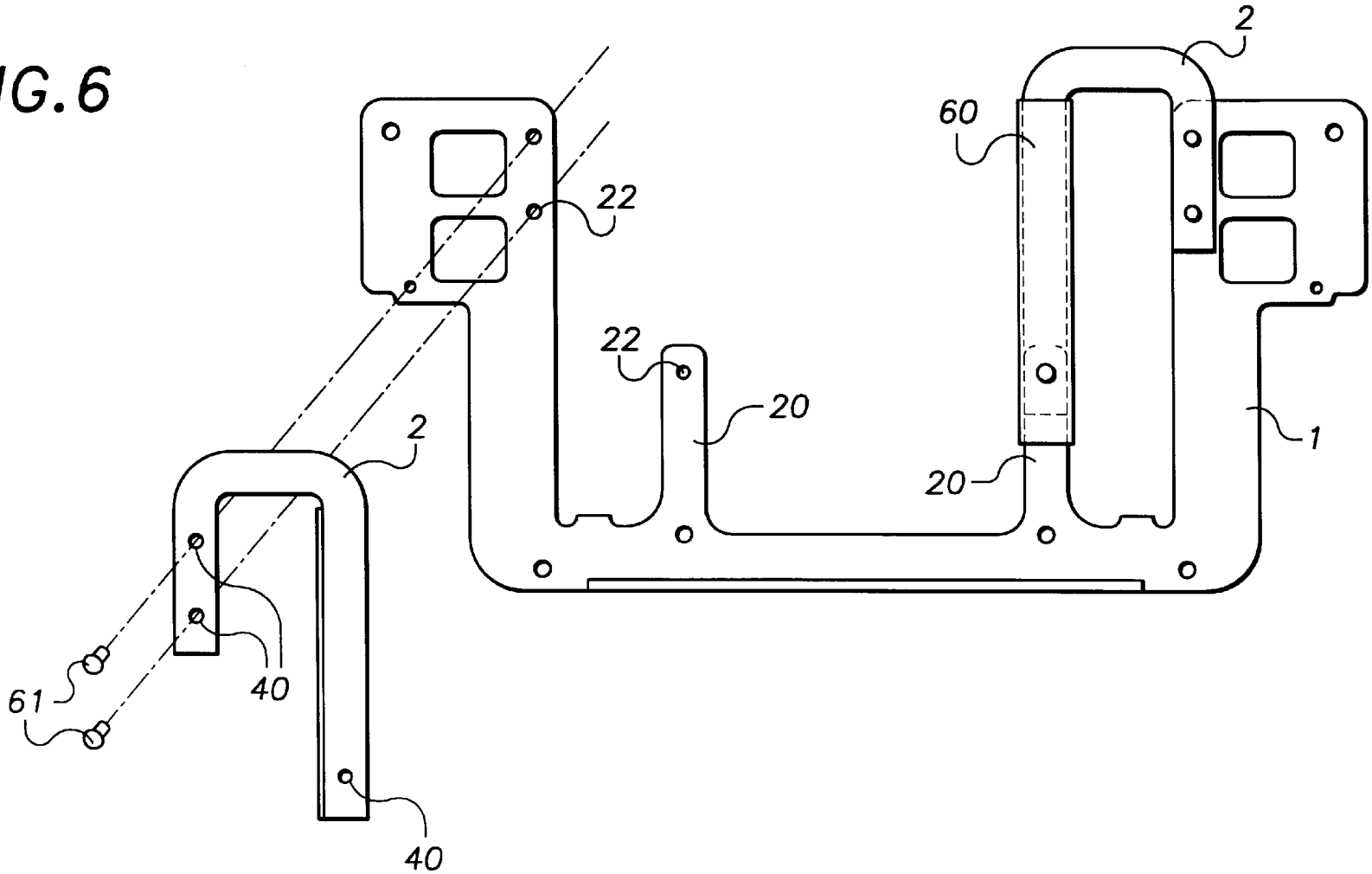
FIG. 6 shows a front view of a partial assemblage of the hoop assembly with one of the two hoop ties secured to the hoop frame and revealing the positioning and mounting location of the second hoop tie.

FIG. 6 reveals how the hoop ties 2 are mounted to the hoop frame 1. Screws 61 or rivets are placed through each hoop tie hole 40 and through the correspondingly aligned support holes 22 on the hoop tie situator 20. The rubber tubing 60 can be seen assembled around the hoop tie 2 already attached to the hoop frame 1. The lower end 40*a* (FIG. 4) of each hoop tie 2 can be fastened to each hoop tie situator 20 by the same means as the terminal end 40*b* (FIG. 4) using the screws 61 or rivets. Preferably, however, the compression force of the rubber tubing 60 is used to secure each lower end 40*a* of the hoop tie 2 to the frame 1, thus eliminating the need for the screws 60.

Figure 7:
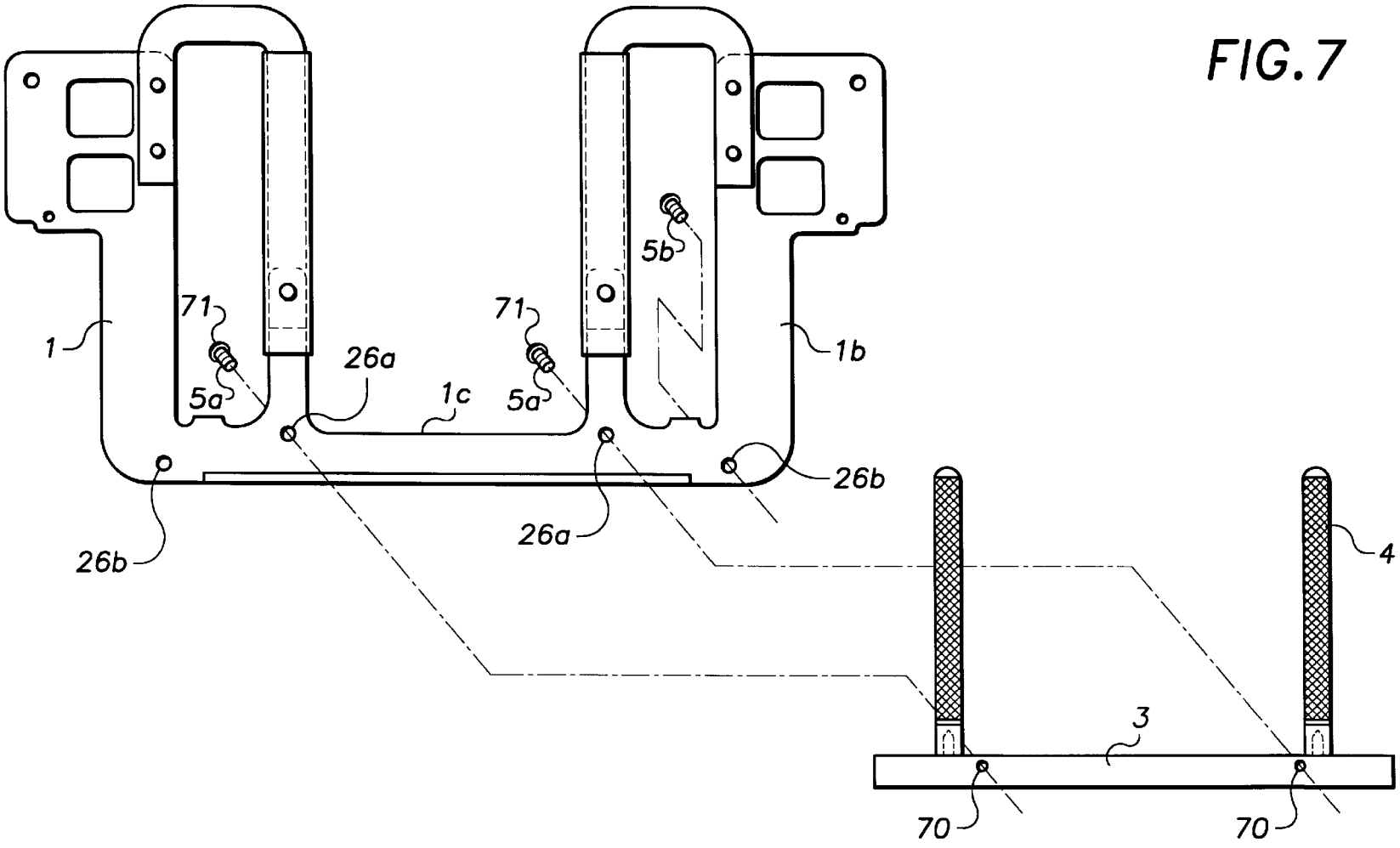
FIG. 7 is a front view showing how a complete assemblage of the hoop assembly involves adjustably mounting the backbone with the knurled fingers proximate to the base of the hoop frame.

With reference now to FIG. 7, the backbone 3, with the hoop fingers 4, is then adjustably mounted by an adjustment means 5*a* and 5*b* to the hoop frame base 1*c*, so that the knurled hoop fingers 4 are situated parallel to said of hoop ties situators of the hoop frame 1. One adjustment means is the height adjustment means 5*a*, which can be any type of screw, spring tensioning device, clamp, or turning knob with threads, Height adjustment means 5*a* is displaced through the inner most pair of backbone holes 26*a* and threadedly attached to opposing holes 70 having smaller diameter than innermost pair of backbone holes 26*a*, such that only heads 71 of height adjustment means 5*a* keep backbone 3 adjustably mounted to hoop frame 1. The height adjustment means 5*a* allows the attached backbone 3 to be raised or lowered to accommodate workpieces of varying thickness.

The angle adjustment means 5*b* are of similar design as the height adjustment means 5*a*, but they do not connect the backbone 3 to the hoop frame 1, and they are threadedly attached through the outermost backbone holes 26*b* in the hoop frame base 1*c*, which are closer to the hoop frame outer perimeter 1*b* relative to the innermost backbone holes 26*a*. In this manner, the angle adjustment means 5*b* can be turned similarly to the height adjustment means 5*a*, but the angle of the hoop fingers 4 is changed rather than the height of the backbone 3. Thus, the workpiece can be variably bent and supported by varying angles depending on the deflection force of the workpiece.

The hoop assembly, now completely assembled, is shown in FIG. 8 as a side view of the hoop assembly in use holding a workpiece. As an example and by no means meant to be limiting, the workpiece in this embodiment is a porfolio cover 80. Similar to other workpieces supported by the present invention, the portfolio cover 80 would be made of leather or vinyl binding a cardboard or heavy paper material. Thus, the present invention is adapted for supporting semi-rigid material for having sewn or embroidered thereon a tough cloth.

The portfolio 80, which is similar to a folded binder, has accordingly an outer surface 80*a*, which is predominantly the most visible surface and is covered with the vinyl or leather in its entirety. Because of this, the outer surface 80*a* is disposed against the non-abrasive rubber tubing 60 on each hoop tie 2. The inner surface 80*b* is held against each hoop finger 4, which is properly adjusted using the angle adjustment means 5*b* and the height adjustment means 5*a* such that the portfolio 80 is snugly supported by the hoop assembly. Thus, this device stabilizes and stretches stiff, or semi-rigid articles in the embroidery machine work area while the stitching is applied to secure the nylon, leather, or other cloth to any underlying backboard. A workpiece that is already assembled in this semi-rigid fashion can further be embroidered on the finished surface, which is accessible in its entirety with the knurled hoop fingers 4 situated beneath. The stiffening rib 27 stiffens the frame 1 to lessen any stress and deflection force. Overall then, the article is not creased, marked, or damaged in any way, yet it is stabilized to allow accurate embroidery.

We claim:

1. A device for supporting semi-rigid workpieces to be embroidered, comprising:

a U-shaped hoop frame having a base, an outer perimeter, an inner surface, and two upper ends;

at least two hoop tie situators extending perpendicularly upwards from said inner surface and formed integral with said hoop frame;

at least two workpiece stops abutting said inner surface of said hoop frame proximate to each of said hoop tie situators;

at least two hoop ties removably attached to said hoop frame at said upper ends and said hoop tie situators to define a support surface, and further comprising a rubber tube support formed integral therewith along a length of each of said hoop ties perpendicularly extending upwards therefrom;

rubber tubing assembled around each of said hoop ties when said hoop ties are mounted to said hoop frame, thereby being stretched and supported by said rubber tube support;

a backbone adjustably mounted to said base of said hoop frame further comprising at least two knurled hoop fingers extending perpendicularly therefrom, said hoop fingers extending parallel to said hoop tie situators when said backbone is mounted to said base; and, a stiffening rib formed integral with and perpendicular to said hoop frame at said base.

2. The device of claim 1, wherein said upper ends extend outwards from said outer perimeter to define a means for mounting said hoop frame to an embroidery machine.

3. The device of claim 1, further comprising a height adjustment means for adjustably mounting said backbone to said base and allowing said backbone with said hoop fingers to be raised or lowered.

4. The device of claim 1, further comprising an angle adjustment means attached through said base allowing an angle of said hoop fingers to be changed.

5. The device of claim 1, wherein said knurled hoop fingers are made of a hard plastic.

6. The device of claim 1, wherein said knurled hoop fingers are made of aluminum.

7. The device of claim 1, wherein said hoop frame is made of metal.

* * * * *